US005132046A

United States Patent [19]

Edebo et al.

[11] Patent Number: 5,132,046

[45] Date of Patent: Jul. 21, 1992

[54] WATER-BASED METAL WORKING FLUID CONTAINING AT LEAST ONE ALKANOLAMINE COMPOUND AS ANTIMICROBIAL AGENT AND A METAL WORKING PROCESS PERFORMED IN THE PRESENCE OF SAID FLUID

[75] Inventors: Lars Edebo, Gothenburg; Michael Sandin, Mölndal, both of Sweden

[73] Assignee: Berol Nobel Stenungsund AB, Stenungsund, Sweden

[21] Appl. No.: 573,316

[22] Filed: Sep. 27, 1990

[30] Foreign Application Priority Data

Mar. 30, 1988 [SE] Sweden ..... 8801174

[51] Int. Cl.[5] ..... C10M 173/00; C10M 133/02

[52] U.S. Cl. ..... 252/49.3; 252/50; 252/49.5; 72/42

[58] Field of Search ..... 252/49.3, 49.5, 50; 72/42

[56] References Cited

U.S. PATENT DOCUMENTS

| | | | |
|---|---|---|---|
| 4,749,503 | 1/1988 | Bennett et al. | 252/49.3 |
| 4,925,582 | 5/1990 | Bennett | 252/49.3 |
| 4,938,891 | 7/1990 | Lenack et al. | 252/49.3 |
| 4,976,919 | 12/1990 | Sköld et al. | 252/49.3 |

FOREIGN PATENT DOCUMENTS

| | | |
|---|---|---|
| 180561 | 5/1986 | European Pat. Off. . |
| 0192358 | 8/1986 | European Pat. Off. . |
| 0196810 | 10/1986 | European Pat. Off. . |
| 0260019 | 3/1988 | European Pat. Off. . |

*Primary Examiner*—Jacqueline Howard

*Attorney, Agent, or Firm*—Spencer, Frank & Schneider

[57] ABSTRACT

A metal working process employs a metal working fluid which is water-based and which is one of neutral and basic, the metal working fluid including a corrosion inhibitor in an amount ranging from 0.1 to 10% by weight; a lubricant selected from the group consisting of mono- or dicarboxylic acids or esters thereof having more than 10 carbon atoms, organic phosphate esters containing one or two hydrocarbon groups having 6–18 carbon atoms, and nonionic alkylene oxide adducts having a molecular weight above 400, and mixtures thereof; and an antimicrobially active amount towards fungi and bacteria of at least one alkanolamine compound having the following general formula

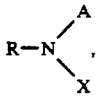

(I)

wherein R is an acyclic hydrocarbon group having 8–14 carbon atoms, A is an hydroxyalkyl group having 2–4 carbon atoms, and X is one of hydrogen. The at least one alkanolamine compound prevents microbial degradation of water-based fluids when included therein.

15 Claims, No Drawings

WATER-BASED METAL WORKING FLUID CONTAINING AT LEAST ONE ALKANOLAMINE COMPOUND AS ANTIMICROBIAL AGENT AND A METAL WORKING PROCESS PERFORMED IN THE PRESENCE OF SAID FLUID

BACKGROUND OF THE INVENTION

Water-based fluids, such as metal working fluids, hydraulic fluids and coolants, undergo after some time of use or storage undesirable changes which can be related to the fact that the components included in the fluids are degraded by bacteria, fungi and other microorganisms. The microbial degradation considerably reduces the life and the performance of the fluids. From an economic point of view, it is therefore of great importance that microbial degradation of fluids of this type be minimized.

BACKGROUND OF THE RELATED ART

Well-known antimicrobial agents used in metal working fluids are formalin or compounds giving off formalin. Since formalin readily evaporates from the fluid in open systems, the formalin content will be successively reduced and the surrounding air contaminated with formalin at the same time. Since formalin is questionable from health and environmental aspects, there is every reason to avoid the use of formalin or compounds giving off formalin.

Other antimicrobial agents are quaternary ammonium compounds, but their use, e.g. in metal working fluids, has involved many practical problems, for instance because of salification with organic acids.

It is also known in cutting fluids and a number of other applications to use as antimicrobial agents reaction products between boric acid and a number of organic compounds, for instance reaction products between alkanolamines, carboxylic acids and boric acid. However, such reaction products have been found to have a relatively low antimicrobial effect, primarily on fungi, and must therefore be used in relatively large amounts.

From articles by E. O. Bennett, e.g. his article in J.A. Soc. Lubr. Eng., 35 (1979), 137–144, and U.S. Pat. No. 4,749,503, it is known that alkanolamine compounds substituted by hydrocarbon groups having 1–6 carbon atoms may have an antimicrobial effect on cutting fluids and coolants. From the results put forth in the article and the U.S. patent, it appears that the effect varies considerably from one case to another, and it is assumed in the article that this is related to the composition of the cutting fluids and the coolants.

The use of a number of alkoxylated amines and alkanolamines in order to obtain a tool life extension is also known from European Patent Applications Nos. 196,810 and 192,358. For metal working fluids containing N-methylethanolamine a lowered susceptibility to the growth of mold and bacteria is reported.

SUMMARY OF THE INVENTION

Thus, there is an evident need to protect metal working fluids and coolants from degradation by microorganisms and to do this in a toxicolsgically and ecologically acceptable manner. According to the present invention, it has now been found that certain alkanolamines substituted by an acyclic hydrocarbon group exhibit excellent antimicrobial properties in water-based, neutral and alkaline fluids. Especially good properties are obtained if the fluids are substantially in the form of a solution. In the present context, "substantially in the form of a solution" means, in addition to a true solution, also a microemulsion, that is, an optically isotropic, thermodynamically stable solution of a water-soluble phase, water and a surfactant, a colloidal solution or any of said solutions, in which a solid has been slurried. The alkanolamines can be added in amounts less than a tenth of the amounts commonly used for conventional antibacterial agents. At the same time, the antimicrobial effect is considerably reduced at slightly acid pH values, and at such pH values the alkanolamines are degradable by microorganisms. Thus, they are also suitable from the ecological point of view.

The alkanolamine compounds according to the invention can be summarised by the general formula

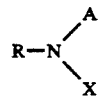

(I)

wherein R is an acyclic hydrocarbon group having 8–14 carbon atoms, A is a hydroxyalkyl group having 2–4 carbon atoms, preferably a hydroxyethyl or a hydroxypropyl group, and X is hydrogen or the group A, where A is as stated above.

As earlier mentioned, the alkanolamines of the formula stated above have antimicrobial effects at neutral or alkaline pH values. Especially good effects are obtained at a pH above 8.

Particularly suitable are such alkanolamine compounds where X is hydrogen. In the case where X is an alkanol group, R is preferably an alkyl group having at least 10 carbon atoms. The alkyl group may be both straight and branched, although straight alkyl groups are preferred. Examples of suitable alkyl groups are octyl, decyl and dodecyl groups.

Extensive tests have shown that compounds of this formula have a good antimicrobial effect on both bacteria and fungi in conventional metal working fluids, such as cutting fluids. The suitable amount to be added varies from one case to another, but generally it is 0.0001–2% by weight.

The metal working fluids contain, in addition to the above-mentioned alkanolamine, conventional corrosion inhibitors in an amount of 0.1–10%, preferably 0.2–3%, by weight of the metal working fluid. Examples of suitable corrosion inhibitors are amine compounds, such as mono-, di- or triethanolamine, triazole or thiadiazole compounds, organic carboxylic acids, preferably having 6–10 carbon atoms, such as azelaic acid, sulphonamidocarboxylic acid, pelargonic acid, isononanoic acid and para-tert-butylbenzoic acid; inorganic acids, such as boric acid; and conventional reaction products between boric acid and organic compounds, such as alkanolamines and carboxylic acids. Examples of corrosion inhibitors are also the amine compounds described in European Patent Publication No. 180,561.

In order to increase the friction-reducing capacity, the metal working fluid also contains lubricants selected from the group consisting of mono- or dicarboxylic acids or esters thereof having more than 10 carbon atoms in the acyl groups, such as fatty acids having 12–18 carbon atoms, organic phosphate esters containing one or two hydrocarbon groups having 6–18 carbon atoms, and nonionic alkylene oxide adducts having a molecular weight above 400, such as polypropylene glycol or randomly distributed polypropylene ethylene glycols or block polymers of ethylene and propylene oxide and mixtures thereof in an amount of 0.05–10%, preferably 0.1–2% by weight of the metal working fluid. Suitable lubricants are sebacic acid, dodecandioic acid, decanoic acid, dodecanoic acid and esters of these acids with polyols, such as trimethylolpropan, pentaerytritol and polyalkylene glycols. The hydrocarbon groups of the organic phosphate esters can be octyl, nonyl, decyl, dodecyl, tetradecyl and hexadecyl, as well as their corresponding unsaturated alkenyl groups. Anionic lubricants also have a corrosion-preventing capacity against iron.

In addition to corrosion inhibitors and lubricants, the metal working fluid may advantageously also contain pH-adjusting agents, perfumes, viscosity-adjusting and solubility-improving agents in known manner. The solubility-improving agents generally consist of low-molecular hydroxyl-containing compounds, such as propylene glycol, diethylene glycol, ethyldiethylene glycol, butyldiethylene glycol or glycerol. Preferably, the metal working composition is substantially in the form of a solution, since the effect of the alkanolamines in an oil-in-water emulsion is appreciably reduced.

The alkanolamine compounds can be added to a vast number of different water-based fluids. The suitable amount to be added varies from one case to another, but generally it is 0.001–2% by weight.

DESCRIPTION OF THE PREFERRED EMBODIMENTS

The present invention is further illustrated by the following Examples.

EXAMPLES 1–2

*Pseudomonas pseudoalcaligenes*, which had been isolated from a cutting fluid, was grown in a glucose-containing nutrient solution for 24 hours. The suspension of bacteria was thereafter centrifuged. The bacteria-containing lower fraction was slurried in a phosphate-buffered sodium chloride solution and diluted with physiological sodium chloride solution to a bacterial concentration of $10^5$ cfu/ml. After the addition of 20% by weight of a glucose-containing nutrient solution and a carbonate buffer to a pH of 9.1, and an alkanolamine according to Table 1 below, incubation was conducted in test tubes for 24 hours at 30° C. After optional dilution, 50 μl of the bacterial suspension was then placed on a nutrient agar plate. After incubation for 3 days at 37° C., the number of living bacterial colonies was counted.

The results obtained, which appear from Table 1, show that the alkanolamines according to formula (I) have a considerably improved bactericidal effect than the alkanolamines in reference tests A-C. Without the addition of alkanolamine, the bacterial concentration was $3.10^7$ cfu/ml.

EXAMPLES 3–4

The tests were carried out in the same way as in Examples 1–2 with the exception that the carbonate buffer was replaced by a phosphate buffer, such that the pH of the bacterial suspension was 7.1. The results obtained, which appear from Table 1, show that the alkanolamines comprised by the invention have a considerably superior bactericidal effect as compared with the alkanolamines in reference test D. Without the addition of alkanolamine, the bacterial concentration was $3.10^7$ cfu/ml.

TABLE 1

| | | Bacterial concentration cfu/ml Added amount of alkanolamine, μM | | | | | |
|---|---|---|---|---|---|---|---|
| Ex. | Alkanolamine | 80 | 200 | 400 | 2000 | 8000 | 20000 |
| 1 | $C_{10}H_{21}NHC_2H_4OH$ | $6 \cdot 10^1$ | <20 | — | — | — | — |
| 2 | $C_8H_{17}NHC_2H_4OH$ | $2 \cdot 10^7$ | $2 \cdot 10^3$ | <20 | — | — | — |
| A | $C_6H_{13}NHC_2H_4OH$ | — | — | $3 \cdot 10^7$ | $2 \cdot 10^4$ | <20 | — |
| B | $C_6H_5CH_2NHC_2H_4OH$ | — | — | — | $2 \cdot 10^7$ | $3 \cdot 10^5$ | <20 |
| C | $C_4H_9NHC_2H_4OH$ | — | — | — | $2 \cdot 10^7$ | $4 \cdot 10^4$ | <20 |
| 3 | $C_{10}H_{21}NHC_2H_4OH$ | $3 \cdot 10^7$ | $5 \cdot 10^5$ | <20 | — | — | — |
| 4 | $C_8H_{17}NHC_2H_4OH$ | — | — | $3 \cdot 10^7$ | $3 \cdot 10^3$ | <20 | |
| D | $C_4H_9NHC_2H_4OH$ | — | — | — | — | $3 \cdot 10^7$ | $3 \cdot 10^7$ |

EXAMPLES 5 AND 6

In a physiological sodium chloride solution, a spore suspension of *Fusarium sp* was prepared which had been isolated from a cutting fluid. After dilution to a spore concentration of $5.10^4$ cfu/ml, 20% by weight of a glucose-containing nutrient solution and a carbonate buffer were added, such that a pH of 9.1 was obtained, as well as an alkanolamine according to Table 2. Incubation then followed in test tubes for 24 hours at 30° C., whereupon 50 μl of the bacterial suspension was placed, after optional dilution, on a nutrient agar plate. After incubation for 3 days at 30° C., the number of mould colonies was counted. The results obtained, which appear from Table 2, show that the alkanolamines in Examples 5 and 6 had a considerably improved fungicidal effect as compared with the alkanolamine in reference tests E and F. Without the addition of an alkanolamine, the mould concentration was $7.10^4$ cfu/ml.

EXAMPLES 7 AND 8

The tests were carried out in the same way as in Examples 5 and 6 with the exception that the carbonate buffer was replaced by a phosphate buffer in such an amount that the pH of the suspension was 7.1.

The results obtained, which appear from Table 2, show that the alkanolamines according to Examples 7 and 8 were superior to the alkanolamine in reference test G. Without the addition of an alkanolamine, the mould concentration was $7.10^4$ cfu/ml.

TABLE 2

| Ex. | Alkanolamine | Spore concentration cfu/ml upon addition of alkanolamine, μM | | | | | |
|---|---|---|---|---|---|---|---|
| | | 20 | 80 | 400 | 2000 | 8000 | 20000 |
| 5 | $C_{10}H_{21}NHC_2H_4OH$ | <20 | <20 | — | — | — | — |
| 6 | $C_8H_{17}NHC_2H_4OH$ | $5 \cdot 10^4$ | <20 | <20 | — | — | |
| E | $C_6H_{13}NHC_2H_4OH$ | — | — | $5 \cdot 10^3$ | <20 | <20 | — |
| F | $C_4H_9NHC_2H_4OH$ | — | — | $7 \cdot 10^4$ | $2 \cdot 10^4$ | 50 | <20 |
| 7 | $C_{10}H_{21}NHC_2H_4OH$ | — | $8 \cdot 10^3$ | 70 | <20 | — | — |
| 8 | $C_8H_{17}NHC_2H_4OH$ | — | — | $8 \cdot 10^3$ | $1 \cdot 10^3$ | <20 | — |
| G | $C_4H_9NHC_2H_4OH$ | — | — | — | — | $7 \cdot 10^4$ | $7 \cdot 10^4$ |

EXAMPLES 9–16

A cutting fluid was prepared from a basic formulation consisting of the following components.

| Component | % by weight |
|---|---|
| Triethanolamine | 47.4 |
| Potassium hydroxide | 6.4 |
| Benzotriazole | 2.1 |
| Isononanoic acid | 14.4 |
| Tartaric acid | 2.1 |
| Water | 27.8 |

83.3 parts by weight of the basic formulation was admixed with an alkanolamine according to Tables 3 and 4 in such amounts that the indicated concentrations were obtained. Water was then added in such an amount that the total amount of water was 97.5% by weight. Finally, the pH of the cutting fluid was adjusted to 9.

To the solution was added an inoculant combination obtained from a cutting fluid and containing three different types of microorganisms, consisting of a bacterial inoculant containing *Pseudomonas aeruginos*, a mould inoculant and a yeast inoculant. The inoculant combination contained on an average $10^6$ cfu/ml of bacteria, $10^5$ cfu/ml of yeast and $2.10^4$ cfu/ml of mould. After 48 hours at 30° C., the concentrations of bacteria, fungi and yeast were determined in the different samples. The results obtained, which appear from Tables 3 and 4, clearly show that the alkanolamines in Examples 9–16 exhibited without exception an antimicrobial effect which was essentially superior to that of the alkanolamines in reference tests H-L.

TABLE 3

| Ex. | Alkanolamine | Bacterial concentration, cfu/ml Amount of alkanolamine, ppm | | |
|---|---|---|---|---|
| | | 140 | 1200 | 4600 |
| 9 | $C_8H_{17}NHC_2H_4OH$ | 0 | | |
| 10 | $C_8H_{17}NHC_3H_6OH$ | 0 | | |
| 11 | $C_{10}H_{21}NHC_2H_4OH$ | 0 | | |
| 12 | $C_{12}H_{25}N(C_2H_4OH)_2$ | 0 | | |
| H | $C_4H_9NHC_2H_4OH$ | $10^5$ | $10^4$ | $10^3$ |
| I | $C_4H_9NHC_3H_6OH$ | $10^5$ | $3 \cdot 10^4$ | 0 |

TABLE 4

| Ex. | Alkanolamine | Mould, change Alkanolamine, ppm | | | Yeast, change Alkanolamine, ppm | | |
|---|---|---|---|---|---|---|---|
| | | 140 | 1200 | 4600 | 140 | 1200 | 4600 |
| 13 | $C_8H_{17}NHC_2H_4OH$ | – | | | – | | |
| 14 | $C_8H_{17}NHC_3H_6OH$ | – | | | – | | |
| 15 | $C_{10}H_{21}NHC_2H_4OH$ | – | | | – | | |
| 16 | $C_{12}H_{25}N(C_2H_4OH)_2$ | – | | | – | | |
| K | $C_4H_9NHC_2H_4OH$ | 0 | - | – | 0 | 0 | – |

TABLE 4-continued

| Ex. | Alkanolamine | Mould, change Alkanolamine, ppm | | | Yeast, change Alkanolamine, ppm | | |
|---|---|---|---|---|---|---|---|
| | | 140 | 1200 | 4600 | 140 | 1200 | 4600 |
| L | $C_4H_9NHC_3H_6OH$ | 0 | - | – | 0 | - | – |

0 = No significant change
- = Significant reduction
– = Killing

What is claimed is:

1. A metal working fluid which is water-based and which has a pH which is one of neutral and basic, the metal working fluid comprising:

a) a corrosion inhibitor in an amount ranging from 0.1 to 10% by weight;

b) a lubricant selected from the group consisting of (i.) mono- or dicarboxylic acids or esters thereof, each acyl group of which has more than 10 carbon atoms, (i.i.) organic phosphate esters containing one or two hydrocarbon groups having 6–18 carbon atoms, (i.i.i.) nonionic alkylene oxide adducts having a molecular weight above 400, and (i.v.) mixtures thereof; and c) at least one alkanolamine compound present in an antimicrobially effective amount toward at least fungi and bacteria, and having a general formula:

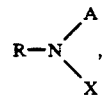

(I)

wherein R is an acyclic hydrocarbon group having 8–14 carbon atoms, A is an hydroxyalkyl group having 2–4 carbon atoms, and X is hydrogen.

2. The metal working fluid according to claim 1, wherein A is one of an hydroxyethyl group and an hydroxypropyl group.

3. The metal working fluid according to claim 1, wherein the alkanolamine compound is present in an amount ranging from 0.0001 to 2% by weight.

4. The metal working fluid according to claim 1, wherein the corrosion inhibitor consists, at least in part, of a) one of mono-, di- and triethanolamine, b) one of a triazole compound and a thiadiazole compound, and c) one of an organic carboxylic acid having 6–10 carbon atoms, boric acid, reation products between boric acid and at least one organic compound, and mixtures thereof.

5. The metal working fluid according to claim 2, wherein the alkanolamine compound is present in an amount ranging from 0.0001 to 2% by weight.

6. The metal working fluid according to claim 2, wherein the corrosion inhibitor consists, at least in part, of a) one of mono-, di- and triethanolamine, b) one of a triazole compound and a thiadiazole compound, and c) one of an organic carboxylic acid having 6–10 carbon atoms, boric acid, reaction products between boric acid and at least one organic compound, and mixtures thereof.

7. The metal working fluid according to claim 3, wherein the corrosion inhibitor consists, at least in part, of a) one of mono-, di- and triethanolamine, b) one of a triazole compound and a thiadiazole compound, and c) one of an organic carboxylic acid having 6–10 carbon atoms, boric acid, reaction products between boric acid and at least one organic compound, and mixtures thereof.

8. A metal working process, comprising: working the metal in the presence of water and a metal working fluid which is water-based, which has a pH which is one of neutral and basic, and which is comprised of;

a). a corrosion inhibitor present in an amount ranging from 0.1 to 10% by weight;

b). a lubricant selected from the group consisting of (i.) mono- or dicarboxylic acids or esters thereof, each acyl group of which has more than 10 carbon atoms, (i.i.) organic phosphate esters containing one or two hydrocarbon groups having 6–18 carbon atoms, (i.i.i.) nonionic alkylene oxide adducts having a molecular weight above 400, and (i.v.) mixtures thereof; and c). at least one alkanolamine compound present in an antimicrobially effective amount toward at least fungi and bacteria, and having a general formula:

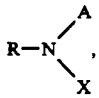

(I)

wherein R is an acyclic hydrocarbon group having 8–14 carbon atoms, A is an hydroxyalkyl group having 2–4 carbon atoms, and X is hydrogen.

9. The metal working process according to claim 8, wherein the metal is worked in the presence of from 0.001 to 2% by weight of the at least one alkanolamine compound.

10. The metal working process according to claim 8, wherein the corrosion inhibitor consists, at least in part, of a) one of mono-, di- and triethanolamine, b) one of a triazole compound and a thiadiazole compound, and c) one of an organic carboxylic acid having 6–10 carbon atoms, boric acid, reactions products between boric acid and organic compounds and mixtures thereof.

11. The metal working process according to claim 8, wherein A is one of an hydroxyethyl group and an hydroxypropyl group.

12. The metal working process according to claim 11, the corrosion inhibitor consists, at least in part, of a) one of mono-, di- and triethanolamine, b) one of a triazole compound and a thiadiazole compound, and c) one of an organic carboxylic acid having 6–10 carbon atoms, boric acid, reaction products between boric acid and at least one organic compound, and mixtures thereof.

13. The metal working process according to claim 9, the corrosion inhibitor consists, at least in part, of a) one of mono-, di- and triethanolamine, b) one of a triazole compound and a thiadiazole compound, and c) one of an organic carboxylic acid having 6–10 carbon atoms, boric acid, reaction products between boric acid and at least one organic compound, and mixtures thereof.

14. The metal working process according to claim 11, wherein the alkanolamine compound is present in an amount ranging from 0.001 to 2% by weight.

15. The process of preventing microbial degradation of water-based fluids due to at least one of bacteria, fungi and yeast, the process comprising:

including in the water-based fluid an antimicrobially effective amount of at least one alkanolamine compound having a general formula:

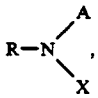

(I)

wherein R is an acyclic hydrocarbon group having 8–14 carbon atoms, A is an hydroxyalkyl group having 2–4 carbon atoms, and X is hydrogen.

* * * * *